US010368676B1

(12) United States Patent
Ansari

(10) Patent No.: US 10,368,676 B1
(45) Date of Patent: Aug. 6, 2019

(54) SECURITY MAILBOX

(71) Applicant: Saadat Ansari, Huntsville, AL (US)

(72) Inventor: Saadat Ansari, Huntsville, AL (US)

( * ) Notice: Subject to any disclaimer, the term of this patent is extended or adjusted under 35 U.S.C. 154(b) by 0 days.

(21) Appl. No.: 16/046,981

(22) Filed: Jul. 26, 2018

Related U.S. Application Data

(60) Provisional application No. 62/537,361, filed on Jul. 26, 2017.

(51) Int. Cl.
*A47G 29/124* (2006.01)
*A47G 29/12* (2006.01)

(52) U.S. Cl.
CPC ... *A47G 29/1248* (2017.08); *A47G 29/12095* (2017.08)

(58) Field of Classification Search
CPC ..... A47G 29/1209; A47G 29/12095; A47G 29/124; A47G 29/1248; A47G 29/1251; A47G 29/20; A47G 29/22
USPC ..... 232/47, 48
See application file for complete search history.

(56) References Cited

U.S. PATENT DOCUMENTS 132,865 A * 11/1872 Sinclaire ..... A47G 29/1209 232/48
384,596 A * 6/1888 Smith ..... A47G 29/1209 232/48
400,299 A * 3/1889 Chappell et al. .. A47G 29/1209 232/48
413,928 A * 10/1889 Cook ..... A47G 29/1209 232/48
465,867 A * 12/1891 Lindsay ..... A47G 29/16 232/24
741,865 A * 10/1903 Williams ..... A47G 29/1209 232/48
807,764 A * 12/1905 Mowers et al. ... A47G 29/1209 232/48
1,111,031 A * 9/1914 Petri ..... A47G 29/1209 232/48
1,150,039 A 8/1915 Klingaman
2,579,877 A 12/1951 Stone
3,401,875 A 9/1968 Bruhns
3,758,027 A 9/1973 Morgan
4,333,603 A 6/1982 Carlson
4,724,999 A 2/1988 Fitzgerald
4,753,386 A 6/1988 Phillion
4,993,626 A 2/1991 Berry
5,435,484 A * 7/1995 Carlson ..... A47G 29/1209 232/17
5,915,618 A 6/1999 Gaudet
(Continued)

*Primary Examiner* — William L Miller
(74) *Attorney, Agent, or Firm* — Mark Clodfelter

(57) ABSTRACT

A security mailbox is configured with a door having an arm on each side of the door that extends downward from the door into a secure mail-holding receptacle. A floor of the mailbox is constructed having longitudinally extending flaps on each side of the mailbox. Each flap has a rail/slide mounted along an underneath side close to the centerline of the mailbox, each rail having a stop at an end near the door. A link extends between a distal end of each arm and a respective rail, with a tension spring that pulls the link and arm toward each other. When the door is initially opened, the arms close the flaps within the first few degrees of door movement by movement of the slides in the rails. When the slides abut the rail stops, the rest of door movement is taken up by the springs.

8 Claims, 6 Drawing Sheets

(56) References Cited

U.S. PATENT DOCUMENTS

| | | | | |
|---|---|---|---|---|
| 6,375,071 | B1 | 4/2002 | Kim | |
| 6,588,656 | B2 | 7/2003 | Cox et al. | |
| 6,644,542 | B2 | 11/2003 | Cox | |
| 7,036,719 | B1 * | 5/2006 | Helphrey ..... | A47G 29/1209 232/30 |
| 7,607,569 | B2 | 10/2009 | Van Rossum | |
| 7,854,374 | B2 | 12/2010 | Dudley | |
| 8,336,760 | B2 | 12/2012 | Skouboe | |
| 8,485,424 | B1 | 7/2013 | Taylor | |

* cited by examiner

SECURITY MAILBOX

CROSS REFERENCE TO RELATED APPLICATIONS

This application claims the benefit of Applicant's provisional application No. 62/537,361, filed Jul. 26, 2017, which is incorporated in its entirety herein.

FIELD OF THE INVENTION

This application relates to security mailboxes, and particularly to a mailbox wherein levers are attached to the door of the mailbox, and which operate a slide mechanism attached to pivoting links that in turn opens or closes trapdoors that serve as the bottom of the mailbox and which open to drop deposited mail into a secure receptacle for retrieval. Notably, the trapdoors are operated at a non-linear rate so that a slight degree of opening the door immediately closes the trapdoors, preventing theft of mail.

BACKGROUND OF THE INVENTION

Mailboxes within which mail in the United States is delivered is typically insecure, with only a simple door closing the mailbox. As such, anyone can open the door to a mailbox and gain access to the delivered mail. This presents an opportunity for thieves to steal checks and packages, for vandals to scatter delivered mail and leave unwanted things inside a mailbox.

There are numerous prior art security mailboxes, some of which having a pair of flaps in the bottom that swing downward to drop mail into a secure receptacle. In some of these prior art references, the receptacle is sufficiently deep so that if the flaps or trapdoors are pried apart, a mail thief would still not be able to reach inside and retrieve mail in the receptacle. One example of this is U.S. Pat. No. 4,724,999. However, this type of mailbox requires that substantially the entire height of the mailbox be a bulky affair that is not sufficiently compact so as to be mounted on a post. In other trapdoor or flap mechanisms, the flaps are braced against being forced open from only one end of the mailbox, leaving the flaps at the other end relatively weak and vulnerable to theft. An example of such a mailbox is U.S. Pat. No. 413,928. Another type of security mailbox has lockable drawers, such as U.S. Pat. No. 5,915,618. The disadvantage of this type of security mailbox is that the drawer does not allow use of the full volume of the mailbox to hold mail and larger packages or envelopes. Yet another type of security mailbox is one in which a security mechanism is operated by cables, such as U.S. Pat. No. 4,753,386. However, with such arrangement, the cables may be cut which would defeat security of the mailbox. In yet another type of mailbox, the flaps or trapdoors are operated by cam surfaces, such as U.S. Pat. No. 7,607,569. In such mailboxes, the effort to operate the cams/flaps can be substantial, and the cams only hold the flaps closed at one location, causing other portions of the flaps to be weak.

Applicant proposes a security mailbox having trapdoor flaps that, when closed, are stronger than security mailboxes of the prior art. In addition, operation of the security portion of the mailbox is spring assisted, which also biases the door of the mailbox closed so that it cannot inadvertently be left open. Another advantage is that the door need only be opened a slight amount in order to close the flaps to a secure mail-holding receptacle.

The drawings are diagrammatic and not to scale, and are intended to show main components of the mailbox and their operative relationships.

DETAILED DESCRIPTION OF THE DRAWINGS

Applicant proposes a security mailbox that has trapdoor-like floor flaps that serve as an interior floor for the mailbox and upon which mail is placed by a mail carrier. The floor flaps are coupled to a mailbox door so that when the mailbox door is in a closed position, the floor flaps swing downward to allow the mail to fall into a mail-holding receptacle below the flaps. When the mailbox door is opened just a few degrees, such as from about 10-25 degrees or so, the floor flaps swing upward to both serve as a floor to receive new mail and close the lower mail-holding receptacle. Particularly, the motion of the floor flaps is non-linear with respect to opening the door such that the floor flaps swing upward and close the lower receptacle when the mailbox door is only slightly opened so that it would be impossible for someone, even a child, to get a hand through the slight gap between the mailbox door and the mailbox opening to access mail in the lower receptacle before the floor flaps close. In addition, with the door open and flaps closed, the floor flaps are locked closed and braced in such a way that they cannot be forced open without destroying the mailbox. Yet another advantage with Applicant's mailbox is that its construction causes the door to be spring loaded so that the door always closes on its own, in turn closing the floor flaps. This is important inasmuch as mail carriers and others may sometimes leave a mailbox door opened.

Figure 1:
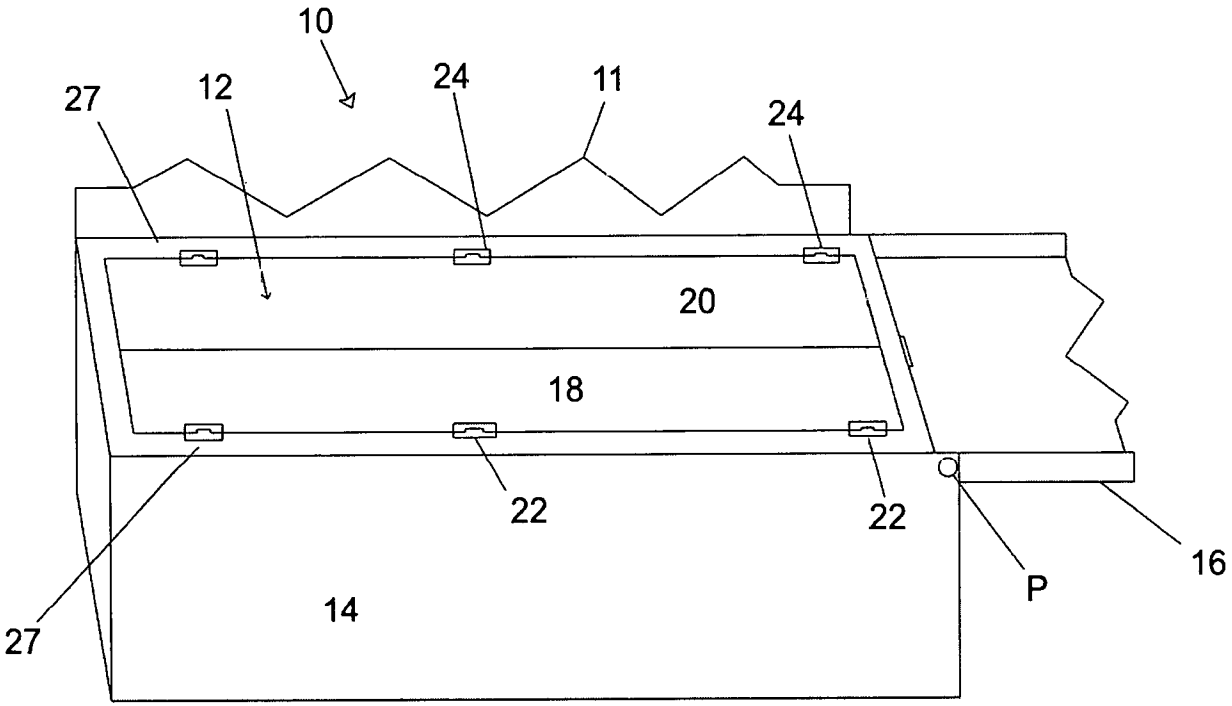
FIG. 1 is a diagrammatic view taken from above and to one side of my new security mailbox showing the door in an open position with floor flaps closed.

Referring to FIG. 1, a mailbox 10 is shown. An upper portion 11 of the mailbox that houses the mail and interior of the mailbox portion is mostly broken away, but may be configured as a conventional or decorative mailbox that meets current mailbox guidelines. These guidelines permit at least two sizes of mailbox, a first size of approximately 19 inches long, 6.5 inches wide and 8.5 inches high. The second size is approximately 23.5 inches long, 11.5 inches wide and 13.5 inches high. A package mailbox may also be used that is approximately 16.5 inches long, 13.63 inches wide, 7.75 inches tall on sides and 12 inches tall in the center. While these are the current standards for mailboxes, Applicant's security mailbox may be constructed of any size as proposed by any future guidelines or rules.

The lower region of the mailbox includes a mail-receiving floor 12 and a lower receptacle 14 into which received mail placed on floor 12 falls when mailbox door 16 is opened.

Door 16 conventionally pivots about a pivot axes P at upper corners of receptacle 14. Floor 12 is constructed of two flaps 18, 20 that are attached by hinges 22, 24, along sides 26, 28, respectively, of lower receptacle 14. While discrete hinges are shown, piano wire hinges extending generally the length of flaps 18, 20 may be used for strength and durability, or other types of suitable hinges may be used.

Figure 2:
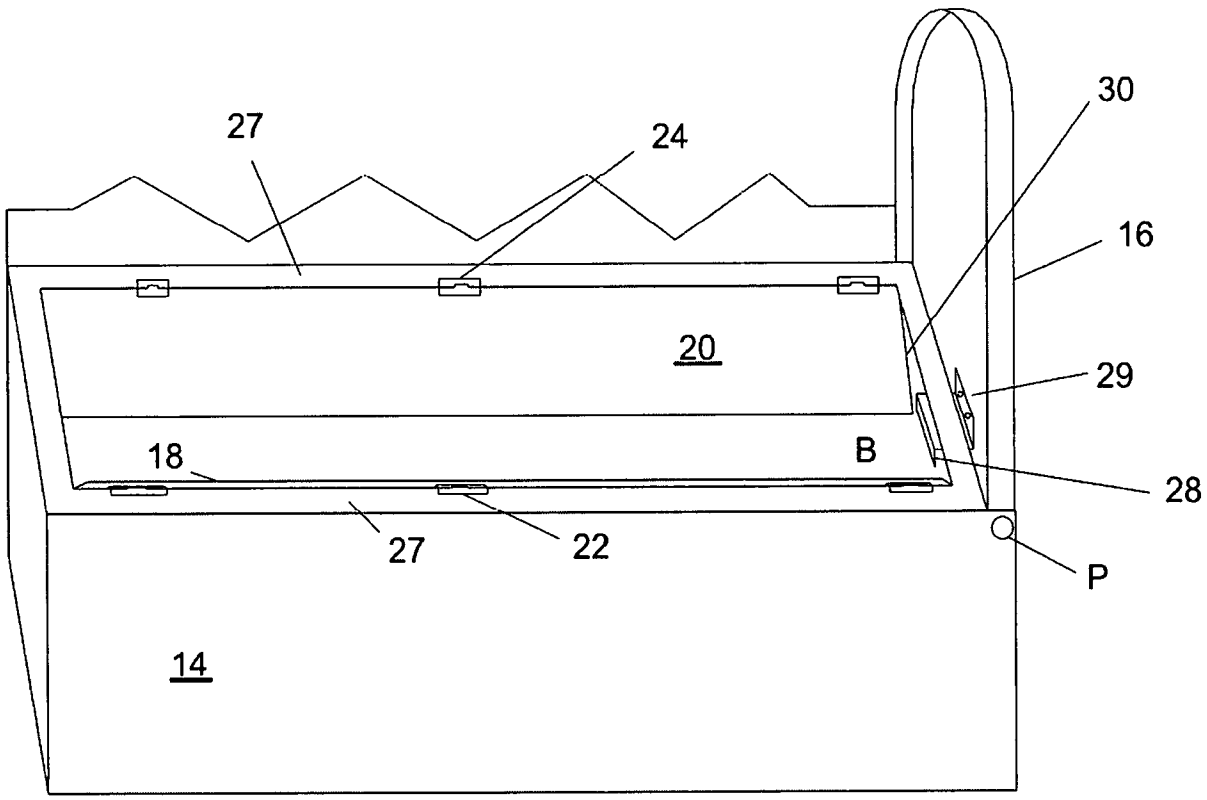
FIG. 2 is a diagrammatic view taken from above and to one side of my new security mailbox showing the door almost closed and the floor flaps in an open position.

With mailbox door 16 in the open position as shown in FIG. 1, flaps 18, 20 are closed to form the mail-receiving floor 12. As shown in FIG. 2, when mailbox door 16 is closed or slightly opened less than a prescribed number of degrees or to a predetermined angle, flaps 18, 20 pivot downward about hinges 22, 24 to allow the mail to fall between flaps 18, 20 into receptacle 14. A lockable/unlockable door 15 (FIG. 5) is provided in receptacle 14, which typically would be at a back of receptacle 14, but which may be in any of the sides of receptacle 14, and allows access for a user as by a conventional lock or the like 17. Also shown in FIG. 2 is a brace member 28 attached to a lower region of door 16, and which braces or supports from below front edges 30 (only one shown in FIG. 2) of flaps 18, 20 when door 16 is opened. Such support provided by brace member 28 prevents the fronts of flaps 18, 20 from being forced downward when door 16 is opened by supporting front edges 30 of flaps 18, 20. A second support or brace is provided at the rear of the mailbox, as will be further explained.

Figure 3:
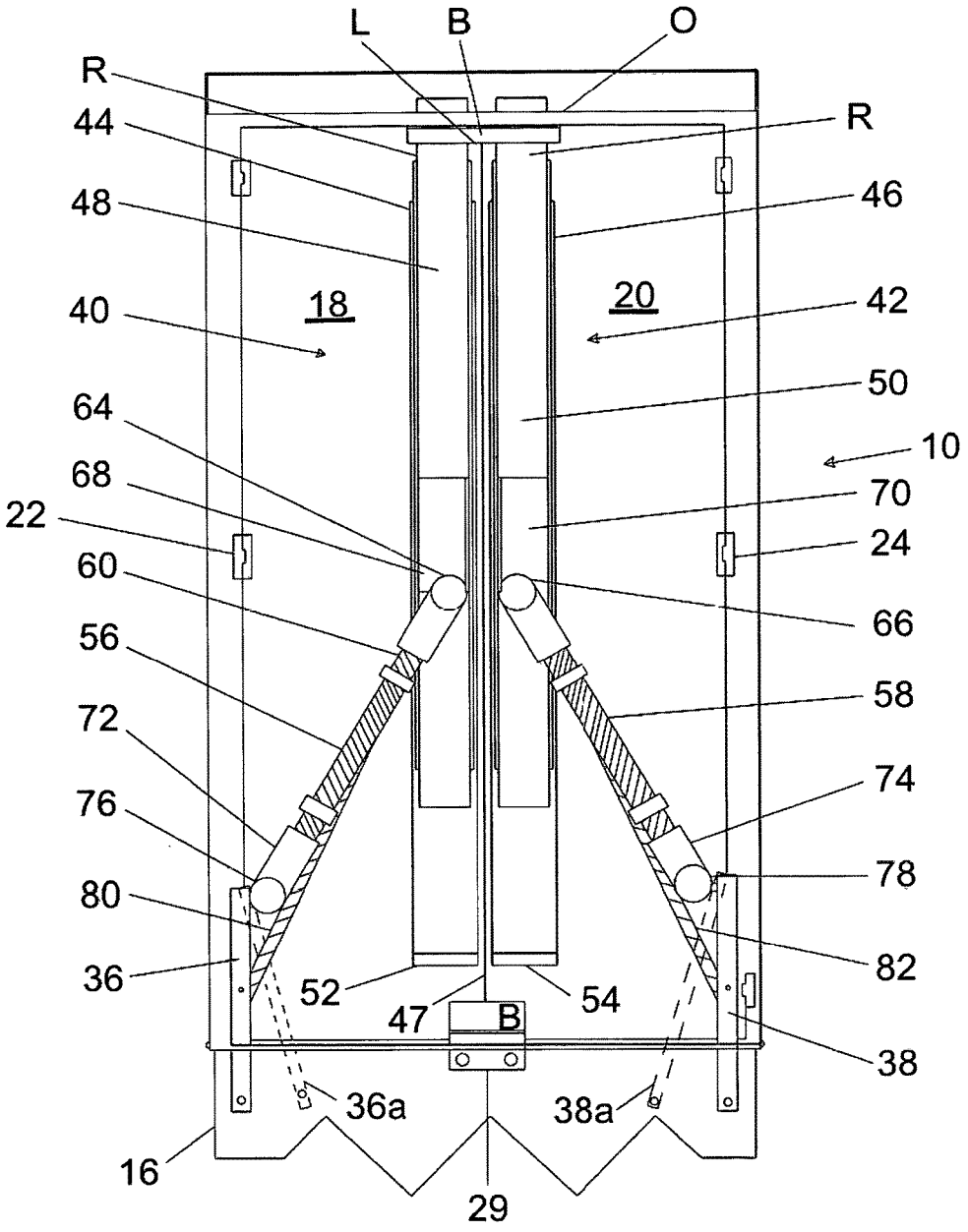
FIG. 3 is a diagrammatic interior view of my new security mailbox from below showing the door open and the floor flaps closed.
Figure 4:
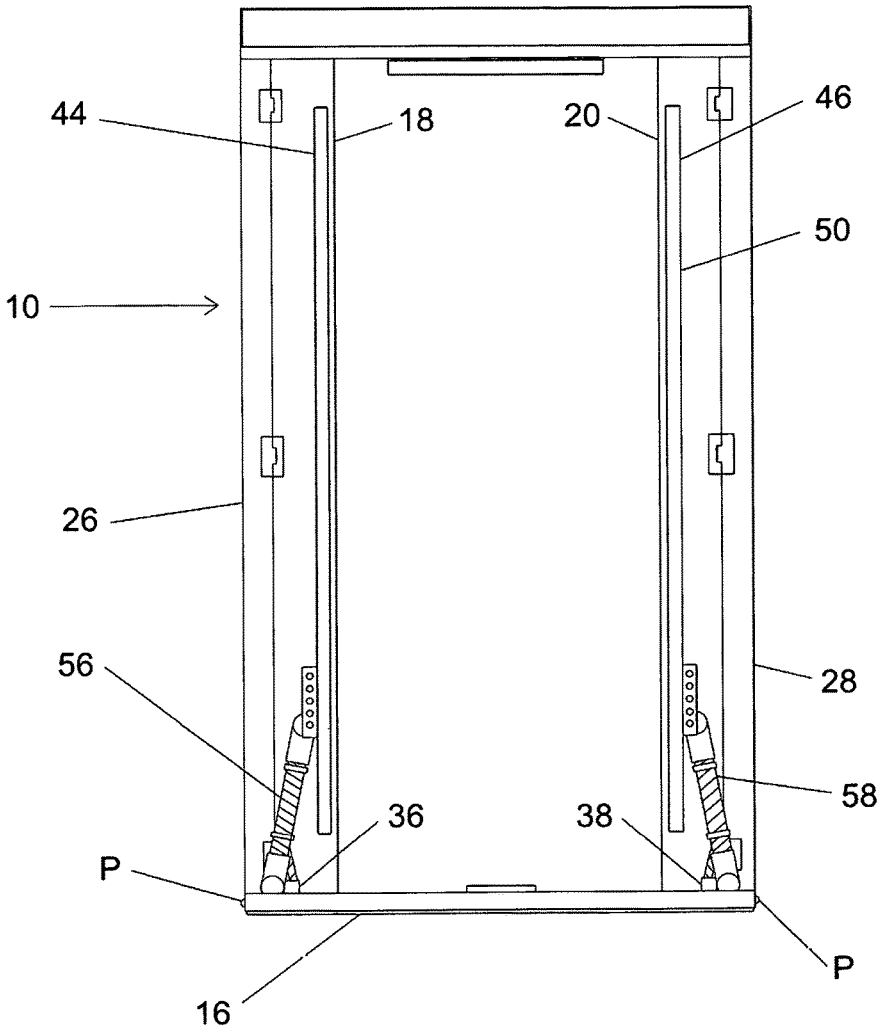
FIG. 4 is a diagrammatic interior view of my new security mailbox from below showing the door closed and the floor flaps open.

Referring to FIG. 3, a view from inside receptacle 14 from below with door 16 open is shown. In order to cause flaps 18, 20 to open and close, a linkage is provided between door 16 and each of flaps 18, 20. Here, attached to door 16 along or near outboard interior sides thereof are two connection bars or arms 36, 38, and which may be in the same or a closely similar plane as door 16, or turned inwardly, as will be further explained. Length of arms 36, 38 is selected in conjunction with the position of track/slide mechanisms 40, 42 in order to fix an angle at which the door is opened corresponding to a closed or nearly closed position of the floor flaps, as will be fully explained. As such, when door 16 is in a vertical closed or almost closed position with flaps 18, 20 open, as shown in FIG. 4, connection bars 36, 38 are also vertical, and when door 16 is opened, connection bars 36, 38 follow the plane of door movement inside receptacle 14 and slightly below flaps 18, 20 toward the horizontal as shown in FIG. 3. Bent edges 27 (FIGS. 1-3) of sides 26, 28 to which hinges 22, 24 are attached form a region thereunder that provides clearance for connection bars 36, 38 and associated hardware. In other embodiments, arms 36, 38 may be moved toward a centerline of the mailbox so that when door 16 is slightly opened, perhaps 10-15 degrees or so, the flaps close, which would allow clearance for arms 36, 38 to move underneath the bottom of the flaps until a point is reached where the door is fully opened and the arms, where they attach more centrally to the door, would be against the inner side of the flaps to prevent them from being forced downward. In these embodiments, with the mailbox door fully opened, the arms would be underneath the flaps and parallel or nearly parallel to the flaps. As such, the arms may cooperate with a brace 29 that locks the flaps 18, 20 against downward force when the door is fully opened, further strengthening the flaps against being forced open. In another embodiment, arms 36*a*, 38*a* (dashed lines in FIG. 3) may be more centrally mounted to the door and angled outward, perhaps 10-25 degrees or so, so that distal ends of the arms are as close to side walls of receptacle 28 as would be allowed. This would allow the flaps to be opened as far as possible while angularly binding corners of the flaps closed when door 16 is opened. As noted, when door 16 is moved from an open to a closed position, flaps 18, 20 remain closed or nearly closed until door 16 reaches a nearly closed angle such as about 10 to 25 degrees or so with respect to floor 12, and only then do flaps 18, 20 open to allow mail to fall into receptacle 14, as will be further explained.

Typically, the angle door 16 makes with floor 12 may be selected in accordance with size of the mailbox. Here, a smaller mailbox, such as the aforementioned mailbox that is 8.5 inches high, may have a greater door angle of perhaps 15-25 degrees due to having a smaller gap than the gap at the same angle that a larger mailbox that is 13.5 inches high would have, so a larger mailbox may need a door angle of 10-15 degrees or so. Any more than about 25 degrees or so for any mailbox would allow too large a gap that might allow a thief to get their hand or grabbing device through the gap and access mail in the lower receptacle. It is believed an angle of less than 20 degrees for most mailboxes except for the largest mailboxes is sufficient to prevent a person from reaching into receptacle 14 through a partially open door 16. In this instance, an angle the door makes with the mailbox when the flaps are sufficiently closed to prevent theft may be around 10-20 degrees or less. In any case, the movement of the flaps is set so that flaps 18, 20 close quickly as the door is opened the first 10 degrees to 25 degrees or so, and remain closed the remainder of movement of the door towards the horizontal. In other words, rate of closure of the flaps is not a linear relationship with rate of opening of the door. Rather, the flaps are closed quickly to a point where mail in receptacle 14 is not accessible as the door is first opened to the predetermined angle of about 10-25 degrees, and remain closed as the door is fully opened.

Figure 5:
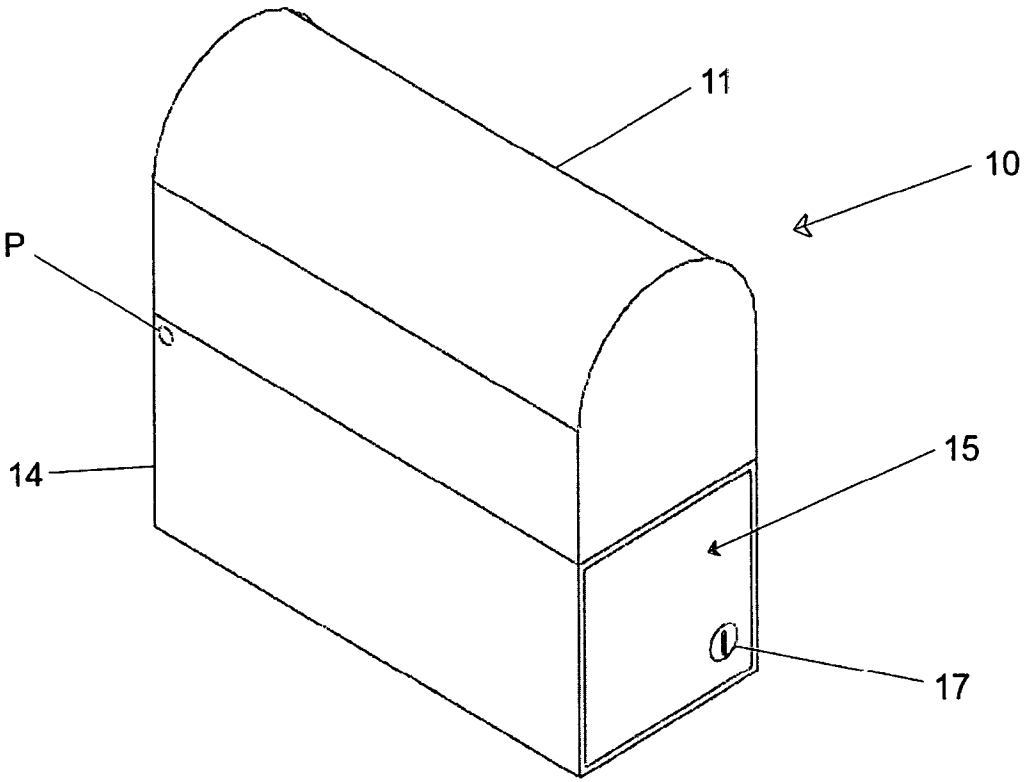
FIG. 5 is a diagrammatic exterior view of my new security mailbox from above and to the rear thereof showing a door and lock by which deposited mail can be retrieved.

In order to facilitate the rapid opening of flaps 18, 20 as door 16 is closed during the last 10-25 degrees or so, track/slide combinations 40, 42 (FIG. 3, 3*a*) are mounted as shown along respective inner edges of flaps 18, 20. Each track/slide combination has a track and a slide, with tracks 44, 46 configured as U-shaped channels with an inwardly-turned lip along each edge so as to capture slides 48, 50 and allow movement of the slides along the tracks. The slide/track combinations may include conventional drawer slides with ball bearings mounted between the tracks and slides, or the track/slides may be custom manufactured and optimized for the mailbox. Where drawer slides with ball bearings are used, friction is greatly reduced, which in turn reduces an amount of force required to operate the flaps. Here, as noted, tracks 44, 46 are mounted along inner edges 47 of flaps 18, 20, respectively, with slides 48, 50 moving vertically upward (as shown in FIG. 3, FIG. 5) when the door is opened and downward in the tracks when the door is closed.

Significantly, and as a feature of the invention, slides 48, 50 are constrained in their downward travel at ends 52, 54 of tracks 44, 46, the ends 52, 54 configured as stops for the slides so that the slides cannot extend past ends 52, 54 (FIG. 3). With these stops, the distance between ends 52, 54 of tracks 44, 46 and front edges of flaps 18, 20 nearest the mailbox door, in combination with the length of arms 36, 38, determines the angle the door makes when the floor flaps are closed. For instance, and still referring to FIG. 3, if tracks 44, 46 are mounted to floor flaps 18, 20 so that ends 52, 54 of the tracks are more toward the door, as shown in FIG. 3, then the angle door 16 makes with floor 12 as door 16 is closed in order to swing flaps 18, 20 downward will be closer to 10 degrees. Conversely, if tracks 48, 50 are mounted so that ends 52, 54 are oriented further from the door, then the angle of the door will be greater, on the order of about 15-25 degrees or so before the flaps are closed. Of course, where ends 52, 54 of tracks 44, 46 are located is determined by where tracks 44, 46 themselves are mounted to the floor flaps 18, 20. The small angle before closing the flaps when the door is opened is necessary in order to open the flaps when the door is closed. Here, lengthening arms 36, 38 would also have the effect of reducing an angle the door is opened to before the flaps close, although this would increase an amount of force needed to open and close the door. In actuality, the length of arms 36, 38 is selected in conjunction with a distance from the door that ends 52, 54 of tracks 48, 50 are located in order to obtain smooth operation of the door and flaps. As should be apparent, the length of the arms and position of the tracks would be different for different sizes of mailbox, and may be obtained by experimentation using arms and slides having adjustments, such as at least a series of openings associated with the tracks, as shown in at least FIGS. 1-6 of the parent provisional application, which is incorporated herein by reference. In addition, arms 36, 38 may not necessarily lie in the same plane as door 15, but rather may be bent inward toward an interior of receptacle 14 and along interior sides thereof by perhaps 15-20 degrees or so and connect to links operating slides 48, 50 inside receptacle 14 rather in a plane with the door.

Arms 36, 38 are connected to slides 48, 50 by links 56, 58. At ends 60, 62 thereof the links are mounted via ball or swivel joints 64, 66 to respective brackets 68, 70 that in turn are attached to slides 48, 50. Likewise, opposite ends 72, 74 of links 56, 58 are attached to connecting rods 36, 38, respectively, via ball or swivel joints 76, 78. The ball or swivel joints allow for movement of the links in all directions. Tension springs 80, 82 between connecting arms 36, 38 and links 56, 58 apply a bias between the arms and links that tends to draw the arms and links together, and which also has the effect of biasing door 16 toward a closed position wherein flaps 18, 20 are closed. While one specific type of linkage is shown, other linkages may be used, especially where it is desired that flaps 18, 20 be lowered to a parallel or almost parallel position with sides of receptacle 14 when the door is closed. For instance, rather than mounting links 56, 58 to brackets that may prevent the doors from swinging down to be parallel with sides of receptacle 14, the links may be mounted directly to the slides, such as by mounting the links to the tops of the slides or by mounting the links to the sides of the slides via an inverted L-shaped bracket and which has a lip that extends to one side of a track and downward toward a respective flap. A plate mounted to the top of the slide and parallel thereto may also be used for mounting the links to the slides.

Still referring to FIG. 3, with door 16 opened and flaps 18, 20 closed, forming the mail receiving floor of the mailbox on the opposite sides thereof, rear ends R of slides 48, 50 are at their furthest extent of rearward travel, and extend a short distance through an opening O in a rear of receptacle 14 underneath flaps 18, 20 to form a second stop/stops at the rear of the flaps. A second brace B may be mounted, as to a rear interior wall of receptacle 14, and may be provided with a lip L against which rear portion R of slides 48, 50 abut when flaps 18, 20 are forced downward after the door is opened. As such, with the door open, the rear of slides 48, 50 are braced against opening O and lip L in receptacle 14 in order to prevent the rear of flaps 18, 20 from being forced downward. In addition, the slides being through opening O in the back of the mailbox prevents at least the rear of the flaps from being pulled upward after the flaps are fully closed. If necessary, the rear edges of the floor flaps 18, 20 or portions thereof may be truncated or cut by perhaps 1-3 inches or so at least along the width of lip L, providing clearance for lip L as the floor flaps swing downward, so that lip L can be extended approximately a distance that slides 48, 50 travel, allowing slides 48, 50 to be braced for that portion of their travel, i.e. 1-2 inches or so, during which the door is being closed but is still at an angle that might allow a thief to get a grabbing device through the door or perhaps force the rear of the floor flaps downward to possibly gain access to mail in receptacle 14. As such, the floor flaps would be braced at the rear by the slides and lip until the door reaches an angle just greater than an angle at which the floor flaps begin to close. As such where the flaps begin to close at 15 degrees, which would necessitate ends R of the slides clearing lip L, such clearing may occur when the door reaches perhaps from about 20 degrees down to about 15 degrees.

At the front of the mailbox, and as best seen in FIGS. 2 and 3, flaps 18, 20 are braced while the door is opened by a brace member 29 mounted to the door, brace member 29 having a bearing surface B (FIG. 2) that bears against the bottom front of floor flaps 18, 20. As the door is opened, the flaps close at about 10-25 degrees of door angle, and the bearing surface B of brace member 29 moves under the front of the flaps as the door is opened. As such, the flaps cannot be forced downward at the front for a thief to access mail in receptacle 14 without ripping out the flaps of the mailbox, ripping off the door or otherwise destroying the interior of the mailbox. As noted above, arms 36, 38 may be mounted such that they approach and bear against the undersides of flaps 18, 20 when door 16 is opened. Particularly, where arms 36, 38 are more centrally mounted to the door and angled outward toward the sides of receptacle 14, small portions of the flaps at the front may be cut out or contoured where necessary to provide clearance for arms 36, 38 to move. The door also may be of heavier gauge metal or other material than the rest of the mailbox, and reinforced at pivots P. Resistance to upward prying of the floor flaps 18, 20 may be obtained by mounting a hook or tab to brace member 28 or other suitable location, and which moves into a corresponding slot in at least one of floor flaps 18, 20 that could overlap the other when the door is opened. Such an arrangement may be similar to the hook arrangement shown in FIG. 7 of U.S. Pat. No. 6,588,656 and discussed at col. 5 lns. 26-30 thereof, FIG. 7 and the accompanying discussion hereby incorporated herein by reference.

Figure 3A:
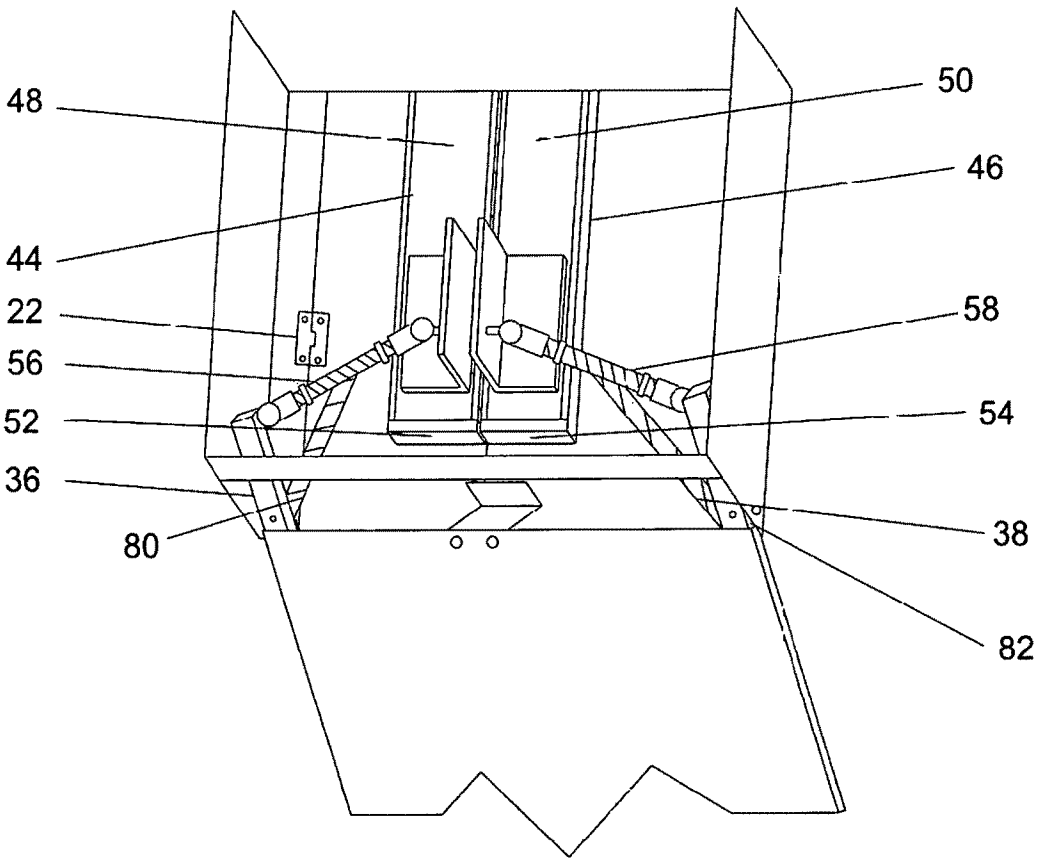
FIG. 3A is a diagrammatic view of my new security mailbox from below showing operation of the mailbox.

In operation, and referring to FIG. 4, showing door 16 closed with flaps 18, 20 in an open position. It is to be noted that links 56, 58 are nearly parallel with floor flaps 18, 20, and appear shortened because the lower ends extend out of the page toward the viewer. As door 16 is opened against the bias of springs 80, 82, connecting arms 36, 38 initially move links 56, 58 sideways (FIG. 3) as assisted by springs 80, 82 to immediately close flaps 18, 20 so that the flaps are closed when door movement reaches the predetermined angle of about 10 degrees to 25 degrees or so. At this point, slides 48, 50 have not yet moved from ends 52, 54 of tracks 44, 46. Continued opening of door 16 beyond the predetermined angle as shown in FIG. 3*a* moves slides 48, 50 toward a rear of the mailbox so that when door 16 is opened beyond the 10-25 degree point, ends 60, 62 of links 56, 58 will be approximately at or just short of being in a middle of the length of flaps 18, 20. This position of links 56, 58 provides support for flaps 18, 20 in addition to support provided by brace 28 mounted to the door and brace B engaged by the rear R of the slides as shown in FIG. 3.

As door 16 is closed with the assistance of springs 80, 82 (FIG. 4), slides 48, 50 are moved by arms 36, 38 downward in tracks 44, 46, which keeps flaps 18, 20 closed until ends of slides 48, 50 abut the constrained ends 52, 54 of tracks 44, 46 (FIG. 3). At this point, the door is at the narrow angle of from about 10 degrees to 25 degrees or so, with the flaps still closed. At this point, as the slides can no longer travel downward in the tracks, continued closing of door 16 then rapidly opens flaps 18, 20, as shown in FIG. 4, this action occurring due to straightening of links 56, 58 into the nearly parallel position shown in FIG. 4. In other words, the floor flaps 18, 20 are initially kept in a closed position as the door is closed by movement of the slides along a plane parallel to the floor flaps, and after the slides abut ends 52, 54 of tracks 44, 46, continued closing of the door forces floor flaps 18, 20 to open by arms 36, 38 pulling links 56, 58 outwardly into the nearly parallel position shown in FIG. 4. As noted, this latter motion is assisted by springs 80, 82. As such, links 56, 58 pull flaps 18, 20 outward as well as downward after slides 48, 50 abut ends 52, 54 of tracks 44, 46. As noted, swiveling motions are accommodated by the ball or swivel joints at each end of the links. As an additional benefit, springs 80, 82 bias door 16 toward a closed position and close floor flaps 18, 20 in the instance where the door is inadvertently left open or not positively closed.

For outgoing mail placed in the mailbox to be picked up by a mail carrier, a spring loaded clip or shelf may be mounted to an interior wall of the mailbox enclosure (not shown). Where a shelf or large clip is used, a spring loaded piano hinge or the like would be attached at floor level along one or both sides to an interior of the mailbox enclosure, and provided with a handle to open the clip. So constructed, the clip may then fold outward and downward toward an interior of the mailbox. A user would grasp a handle of the clip and move it outward and downward against the bias of the spring toward the interior of the mailbox enclosure and place outgoing mail between the clip and an adjacent interior wall of the mailbox enclosure where it is held in place by the bias of the spring. In other embodiments, a shelf may be provided along one or both interior sides of the mailbox enclosure to hold outgoing mail. This would prevent outgoing mail placed between the clip or shelf and interior wall of the mailbox enclosure from falling into receptacle 14 when mailbox door 16 is closed. The mail carrier would retrieve outgoing mail simply by pulling the outgoing mail from between the clip and interior wall.

While a particular spring bias arrangement is shown for biasing the floor flaps closed, other spring mechanisms may be employed. For instance, a torsion spring may be mounted at a rear of the mailbox, with the legs of the torsion spring mounted to bias the flaps, and thus the door, toward closed positions. Of course, in addition to a receptacle below the flaps for holding deposited mail, the mailbox exterior would be constructed to house all the operative parts thereof.

While one exemplary embodiment is shown, along with a description of multiple embodiments, it should be apparent that any of the various components of the disclosed embodiments may be used in any operative combination.

Having thus described my invention and the manner of its use, it should be apparent to one of ordinary skill in the arts to which the invention pertains that incidental changes may be made thereto that fairly fall within the scope of the following appended claims, wherein I claim:

1. A security mailbox comprising:

a mailbox enclosure for housing mail deposited by a mail carrier, a mail holding receptacle below the mailbox enclosure, the mail holding receptacle having a lockable door, for allowing retrieval of the mail in the mail holding receptacle, a floor between the mailbox enclosure and the mail holding receptacle, the floor comprising two flaps extending longitudinally between the mailbox enclosure and the mail holding receptacle, each flap of the two flaps hingably attached along opposed inner sides of the mail holding receptacle, for pivoting movement of the two flaps, the two flaps pivoting downward to form an opening through which the mail falls into the mail holding receptacle and the flaps pivoting upward to form the floor, a track mounted to a lower side and along an inner edge of each said flap, each said track having a slide that is captured by the track and moving within the respective track, each said track further having a slide stop positioned at a front of the track for limiting forward movement of a respective said slide, the slide stop positioned at a predetermined point that defines initiation of opening and closing of the two flaps, a mailbox door pivotally attached at sides of a bottom front of the mailbox enclosure, a pair of downwardly depending connection bars mounted to a lower inner side of the mailbox door, one connection bar for each said flap, the connection bars extending into the mail holding receptacle and mounted to move upward within the mail holding receptacle when the mailbox door is opened and downward when the mailbox door is closed, a link connected between each said connection bar and a respective said slide, the link having a swivel connector at each end, for moving in swiveling relation with a respective said slide and respective said flap, a spring bias for biasing each said flap toward an open position so that the mail falls from the mailbox enclosure into the mail holding receptacle when the mailbox door is closed, and further biasing the mailbox door closed, whereby the predetermined point of the slide stop on each track defines an angle the mailbox door makes with the floor to begin to open or close the two flaps.

2. A security mailbox as set forth in claim 1 wherein the slide stop on each said track is positioned to open a respective said flap at an angle of about 10-25 degrees as the mailbox door is closed, and allow the mailbox door to fully close with the two flaps opened, and to close a respective said flap when the mailbox door is opened to an angle of about 10-25 degrees with respect to the floor, with continued opening movement of the mailbox door to a fully opened position occurring with the two flaps closed.

3. A security mailbox as set forth in claim 2 further comprising a floor stop connected to an inner bottom surface of the mailbox door, the floor stop moved to a position below the two flaps when the mailbox door is open, preventing the two flaps from being forced open by downward pressure on the two flaps.

4. A security mailbox as set forth in claim 2 further comprising an opening in a rear of the mail holding receptacle, the opening aligned with each said slide when the mailbox door is open and the two flaps closed, with each said slide being of a sufficient length to extend into the opening when the mailbox door is open, preventing the two flaps from being forced open by downward pressure on the flaps.

5. The security mailbox as set forth in claim 2 wherein the pair of downwardly depending connection bars are each mounted to the mailbox door so that the pair of connection bars are angled outwardly toward respective sides of the mail holding receptacle, bracing outer front corners of respective said flaps to brace the flaps from being forced downward.

6. The security mailbox as set forth in claim 2 wherein an end of each connection bar of the pair of connection bars to which one end of a respective said link is connected terminates at a respective side wall of the mail holding receptacle, with an other, distal end of the respective link attached to a respective said slide at a point such that as the mailbox door is closed from a fully open position, each said slide is moved within a respective said track toward a respective slide stop, keeping the two flaps closed, and when each slide abuts a respective said slide stop when the mailbox door is at about 10-25 degrees with respect to the floor, further closing of the mailbox door pulls the distal end of each said link towards a respective side wall of the mail holding receptacle, thereby lowering the flaps to allow the mail to fall into the mail holding receptacle.

7. A security mailbox comprising:

a mailbox enclosure for housing mail deposited by a mail carrier, a mail holding receptacle below the mailbox enclosure, the mail holding receptacle having a lockable door, for allowing retrieval of the mail in the mail holding receptacle, a floor between the mailbox enclosure and the mail holding receptacle, the floor comprising two flaps extending longitudinally between the mailbox enclosure and the mail holding receptacle, each flap of the two flaps hingably attached along opposed inner sides of the mail holding receptacle, for pivoting movement of the two flaps, the two flaps pivoting downward to form an opening through which the mail falls into the mail holding receptacle and the flaps pivoting upward to form the floor, a track mounted to a lower side and along an inner edge of each said flap, each said track having a slide that is captured by the track and moving within the respective track, each said track further having a slide stop positioned at a front of the track for limiting forward movement of a respective said slide, the slide stop positioned at a predetermined point that defines initiation of opening and closing of the two flaps, a mailbox door pivotally attached at sides of a bottom front of the mailbox enclosure, a pair of downwardly depending connection bars mounted to a lower inner side of the mailbox door, one connection bar for each said flap, the connection bars extending into the mail holding receptacle and mounted to move upward within the mail holding receptacle when the mailbox door is opened and downward when the mailbox door is closed, a link connected between each said connection bar and a respective said slide, the link having a swivel connector at each end, for moving in swiveling relation with a respective said slide and respective said flap, a spring bias for biasing each said flap toward an open position so that the mail falls from the mailbox enclosure into the mail holding receptacle when the mailbox door is closed, and further biasing the mailbox door closed, a floor stop connected to an inner bottom surface of the mailbox door, the floor stop moved to a position below the two flaps when the mailbox door is open, preventing the two flaps from being forced open by downward pressure on the two flaps, an opening in a rear of the mail holding receptacle, the opening aligned with each said slide when the mailbox door is open and the two flaps closed, with each said slide being of a sufficient length to extend into the opening when the mailbox door is open, preventing the two flaps from being forced open by downward pressure on the flaps, whereby the predetermined point of the slide stop on each track defines an angle the mailbox door makes with the floor to begin to open or close the two flaps.

8. The security mailbox as set forth in claim 7 wherein an end of each connection bar of the pair of connection bars to which one end of a respective said link is connected terminates at a respective side wall of the mail holding receptacle, with an other, distal end of the respective link attached to a respective said slide at a point such that as the mailbox door is closed from a fully open position, each said slide is moved within a respective said track toward a respective slide stop, keeping the two flaps closed, and when each slide abuts a respective said slide stop when the mailbox door is at about 10-25 degrees with respect to the floor, further closing of the mailbox door pulls the distal end of each said link towards a respective side wall of the mail holding receptacle, thereby lowering the flaps to allow the mail to fall into the mail holding receptacle.

* * * * *